US005237893A

United States Patent [19]

Ryder et al.

[11] Patent Number: 5,237,893

[45] Date of Patent: Aug. 24, 1993

[54] DRIVER WITH FASTENER RETENTION MEANS

[75] Inventors: Francis E. Ryder, Arab; Rowland W. Kanner, Guntersville, both of Ala.

[73] Assignee: Textron Inc., Providence, R.I.

[21] Appl. No.: 526,609

[22] Filed: May 22, 1990

[51] Int. Cl.[5] ..... B25B 23/00

[52] U.S. Cl. ..... 81/452; 81/460; 81/436; 81/451

[58] Field of Search ..... 81/436, 460, 461, 451, 81/452, 458, 459

[56] References Cited

U.S. PATENT DOCUMENTS

| | | | |
|---|---|---|---|
| 2,083,092 | 6/1937 | Richer | 81/460 |
| 3,584,667 | 6/1971 | Reiland . | |
| 4,060,114 | 11/1977 | Matsushima | 81/460 |

OTHER PUBLICATIONS

Line Head System, Inc., Fastening System Brochure, Date approximately 1990, General Reference.

Snap-on Medical Products, "Captive Twist" Information Sheet, Date approximately 1990, General Reference.

*Primary Examiner*—Bruce M. Kisliuk

*Assistant Examiner*—Lawrence Cruz

[57] ABSTRACT

A fastener drive tool for applying a rotational torque to a threaded fastener for driving the fastener into or out of a workpiece. The drive tool has an elongated shaft portion with a free end which is engageable with a recess formed in the fastener. Alternating merging concave and convex partially-cylindrical surfaces are formed on the outside of the shank towards the free end of the drive tool. The axes of curvature of the concave and convex partially-cylindrical surfaces are generally parallel to one another. The drive tool has at least one interlobular fastener retention piece attached between two convex partially-cylindrical surfaces which engage a corresponding convex partially-cylindrical surface formed in the fastener recess. The interlobular fastener retention piece releasably retains the fastener on the drive tool when the drive tool is engaged with the recess formed in the fastener and prevents wobbling of the fastener when it is driven by the drive tool.

15 Claims, 2 Drawing Sheets

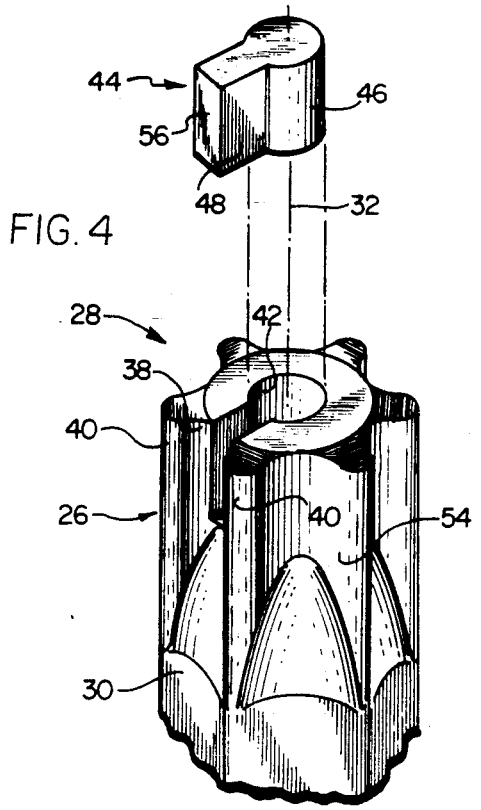
FIG. 4
FIG. 5
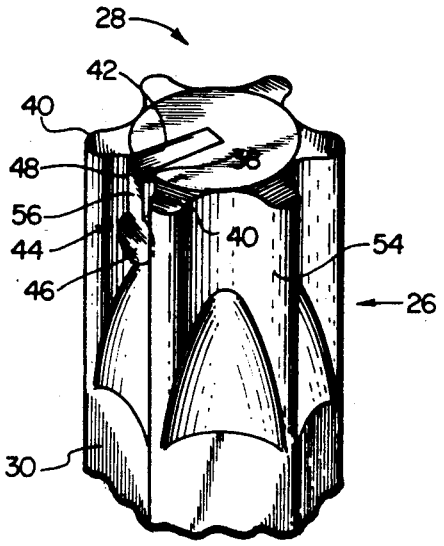
FIG. 6
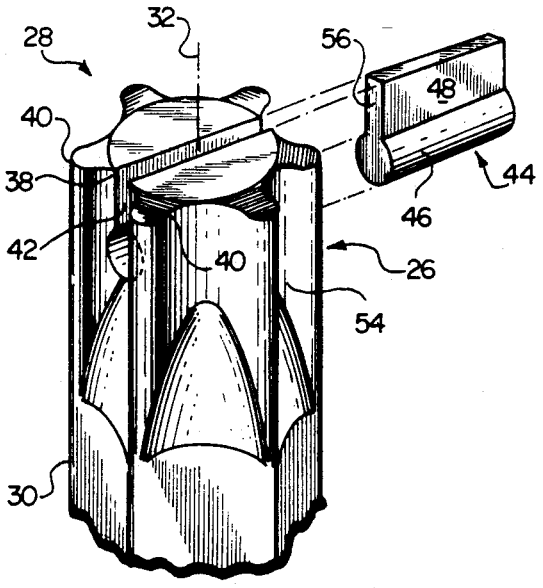
FIG. 7
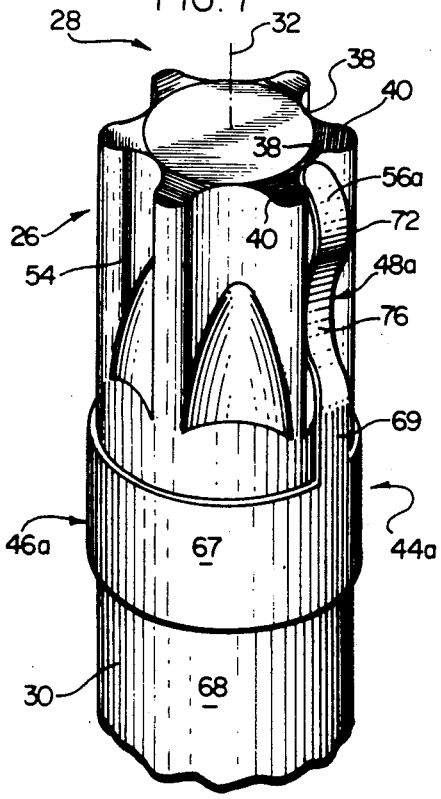

DRIVER WITH FASTENER RETENTION MEANS

BACKGROUND OF THE INVENTION

This invention relates generally to the fastener drive tool art and more particularly to a fastener drive tool which retains a fastener on the end thereof.

In many fastener applications it is desirable to retain the fastener on the end of the drive tool and to prevent the fastener from wobbling while it is being driven. Retention of a fastener on the end of a drive tool allows the fastener to be driven in an area which might normally be inaccessible. Also, when a fastener is retained on the end of the drive tool only one hand is needed to drive the fastener since one hand is not occupied holding and positioning the fastener. An easily releasable securely retaining friction fit is preferred for retaining a fastener on a drive tool. In attempting to satisfy the need for such a drive tool, prior art fastener retaining drive tools have employed retaining features including magnetic retainers, external fastener retaining fingers as well as spirally formed drive bits.

Each of the aforementioned prior art retaining features has limitations and generally results in a degree of wobble while the fastener is being driven by the drive tool. A common problem encountered by most fastener retaining drive tools is that the variation in tolerances between a drive tool bit portion and a fastener receptacle deters retention of the fastener on the drive tool.

The type of engagement between the fastener and the driver is very important since prior art fastener drive systems do not provide sufficient retaining forces between the driver and the fastener. For example, many prior art systems have a problem with "cam out", which forces the bit portion out of the fastener recess, potentially damaging the surface of the area surrounding the fastener. Cam out occurs when driving torque is applied to the inclined walls in the recess formed in a typical prior art fastener such as a cruciform or Philips-type fastener. While in certain situations cam out can be overcome by increasing the end load on the driver to more securely force it into the recess, additional end load will increase the damage caused to the surrounding surface if and when the driver "cams out" of the recess.

With regard to problems with wobbling, prior art fasteners mentioned above wobble while being driven as a result of the insufficient intimate engagement between the drive tool and the fastener recess. If a fastener wobbles while being driven the fastener may create an oversized hole which decreases the degree of engagement and hence retaining strength between the fastener and the workpiece in which it is driven. Further, if the wobbling results in driving the fastener at an angle, the fastener may undesirably protrude from the surrounding surface of the workpiece and joined members may be misaligned.

While some prior art drivers and fasteners have been developed which substantially overcome cam out, these fasteners still may have a degree of wobble about a central axis extending through the fastener and drive tool. In one form of prior art fastener and drive tool, the fastener has a recess formed on a top surface of the head and the driver has a cooperatively mating male protrusion which is formed to engage the recess in the fastener. An example of such a fastener and driver combination is the standard hexalobular TORX fastener and corresponding driver, U.S. Pat. No. 3,584,667. The standard TORX fastener employs a driver bit which, in cross-section, has six equidimensioned and equispaced curved lobes which engage corresponding cross-sectional shaped recesses in the head of the fastener. The sides of the standard TORX fastener are generally parallel to the central axis. Retention of the TORX fastener on the drive tool is at least partially dependent upon the tolerances between the drive tool and the fastener and typically there is a degree of wobble resulting from variations in these tolerances.

The dimensional tolerances between the drive tool and fastener are generally rather precise, however, even minor dimensional variations may produce undesirable results under some circumstances. While most fasteners are retainable on the drive tool, if a batch of fasteners are produced with recesses at the extreme of the large acceptable dimensional tolerance for fasteners and a drive tool is formed with a bit portion at a generally small acceptable dimensional tolerance for drive tools the fasteners probably will not be retainable on the drive tool. Further, even with minor, and acceptable, dimensional variations, a degree of wobble is produced when the fastener is driven by the drive tool. The problem concerning dimensional tolerances is further exacerbated when the drive tool is used for driving a large number of fasteners such that the material on the outside of the drive tool, which engages the fastener recess, becomes worn. Wear typically reduces the material on the outside surface of the drive tool increasing the disparity between the drive tool and fastener dimensional tolerances and reducing the degree of intimate engagement.

In attempting to overcome some of the aforementioned problems, at least one prior art fastener and drive tool claims to overcome both retention and the wobbling problems. Such a fastener is believed to have been formed with a tool and fastener engagement design similar to the hexalobular design of a standard TORX fastener. However, this prior art device was formed with a slight spiral curve to the lobes on the outside of the drive tool and a corresponding spiral curve to the cooperatively formed mating recess in the fastener. While a fastener might be retainable on a tool using such spirally formed surfaces, it is believed that it is very difficult to remove the drive tool from the fastener once driven. Difficulty in removing the drive tool from the fastener could actually result in loosening the fastener once driven. Further, since this type of fastener and drive tool are specialized, the drive tool only drives specific types of fasteners and cannot be used with other types of standard fasteners.

Therefore, it would be preferable to provide a drive tool which is capable of retaining a fastener and prevents wobble while driving the fastener. Further, it is desirable to provide a drive tool which retains a fastener and reduces wobble, and which may be used with standard fasteners.

The present invention, as will be detailed more fully hereinafter, overcomes the above-described problems. More specifically, the present invention provides a drive tool which retains a fastener on the end thereof, prevents wobbling of the fastener while it is driven, is generally easily removable from the fastener, and may be employed to drive standard non-specialized fasteners.

OBJECTS AND SUMMARY OF THE INVENTION

A general object of the present invention is to provide a drive tool which retains a fastener on the end thereof.

Another object of the present invention is to provide a drive tool which reduces the degree of wobble induced on the fastener while when it is driven by the drive tool.

Yet another object of the present invention is to provide a drive tool which retains a fastener on the end thereof and reduces the degree of wobble induced in the fastener while it is driven and may be employed to drive standard fasteners.

In accordance with the foregoing, the present invention is a fastener drive tool for applying a rotational torque to a threaded fastener for driving the fastener into or out of a workpiece. The drive tool has an elongated shaft portion with a free end which is engageable with a recess formed in the fastener. Alternating merging concave and convex partially-cylindrical surfaces are formed on the outside of the shank towards the free end of the drive tool. The axes of curvature of the concave and convex partially-cylindrical surfaces are generally parallel to one another. The drive tool has at least one interlobular fastener retention piece attached between two convex partially-cylindrical surfaces which engage a corresponding convex partially-cylindrical surface formed in the fastener recess. The interlobular fastener retention piece removably retains the fastener on the drive tool when the drive tool is engaged with the recess formed in the fastener and prevents wobbling of the fastener when it is driven by the drive tool.

BRIEF DESCRIPTION OF THE DRAWINGS

The organization and manner of the operation of the invention, together with the further objects and advantages thereof, may best be understood by reference to the following description taken in connection with the accompanying drawings in which like reference numerals identify like elements in which:

FIG. 4 is an exploded perspective view of an end of the drive tool in which an interlobular fastener retaining member having an axis generally coaxial with a central axis of the drive tool is removed from a keyway formed on the end of the drive tool;

FIG. 5 is a perspective view of the end of the drive tool in which the interlobular fastener retaining member is retained in a keyway formed having an axis generally perpendicular to a central axis of the drive tool;

FIG. 6 is an exploded perspective view of the end of the drive tool as illustrated in FIG. 5; and FIG. 7 is a perspective view of an alternative embodiment of the present invention employing an interlobular fastener retaining member which does not require a keyway.

Figure 1:
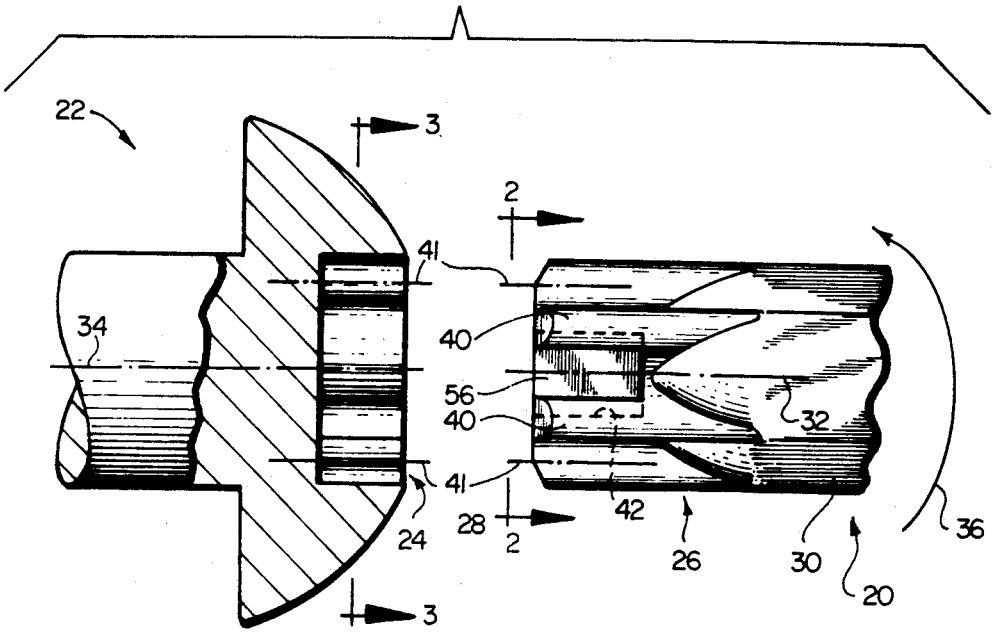
FIG. 1 is a partial fragmentary side view of a drive tool bit portion positioned for insertion into a fastener recess formed on an end of a fastener.

It should be noted that dimensional relationships between the members of the illustrated embodiment may vary in practice and may have been varied in the illustrations to emphasize certain features of the invention.

DETAILED DESCRIPTION OF THE ILLUSTRATED EMBODIMENT

While this invention may be susceptible to embodiment in different forms, there is shown in the drawings and will be described herein in detail, embodiments of the present invention with the understanding that the present disclosure is to be considered an exemplification of the principles of the invention, and is not intended to limit the invention to the embodiments illustrated.

FIG. 1 provides a partial fragmentary side view of a drive tool 20 positioned for engagement with a fastener 22. The fastener 22 has a recess 24 formed in the top thereof which is cooperatively engageable with a bit portion 26 formed on a free end 28 of a shank portion 30 of the drive tool 20. A bit axis 32 extends through the shank portion 30 and is generally coincident with a central axis 34 of the fastener 22. When the bit portion 26 of the drive tool 20 is inserted into the recess 24 of the fastener 22, rotational torque (indicated by arrow 36) about the bit axis 32 is transferred to the fastener 22 to rotate the fastener 22 about the central axis 34.

Figure 2:
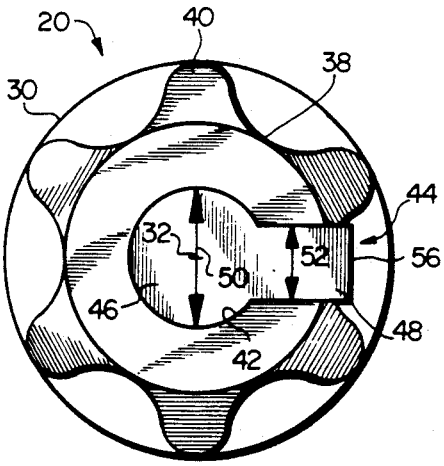
FIG. 2 is an end view of the drive tool taken along line 2—2 in FIG. 1.

As better shown in the end view of the drive tool 20 taken along line 2—2 as illustrated in FIG. 2, the bit portion 26 is formed with multiple merging concave and convex partially-cylindrical surfaces or bit flutes 38 and bit lobes 40. In the particular embodiment illustrated in FIG. 2, six bit flutes 38 and six bit lobes 40 are illustrated and are commonly referred to as a hexalobular shape. The bit flutes 38 and bit lobes 40 have axes of curvature 41 which are parallel to one another and to the central axis 34 and the bit axis 32.

A bore or keyway 42 is formed through the free end 28 of the bit portion 26 for receiving and retaining interlobular fastener retention means 44 therein. The interlobular fastener retention means 44 is formed with a retaining portion 46 and a stem portion 48 attached to the retaining portion 46. A width dimension 50 of the retaining portion 46 is generally larger than a width dimension 52 of the stem portion 48. The width dimension 50 being larger than the width dimension 52 facilitates retention of the interlobular fastener retention means 44 in the keyway 42. The interlobular fastener retention means 44 is formed for creating an interference fit between the outside surface 54 thereof and the keyway 42.

The retention means 44 is an integral single piece body formed of a resiliently compressible material of approximately durometer 40. Such retention means 44 may be formed by extruding, casting or otherwise forming the cross-sectional shape of the keyway 42.

Figure 3:
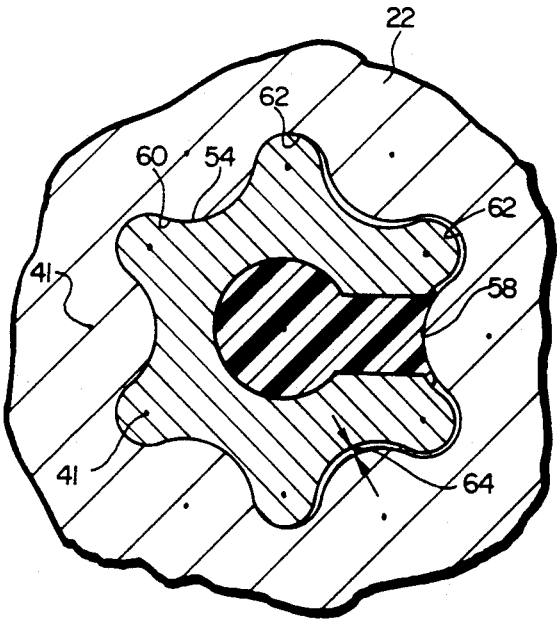
FIG. 3 is a partial cross-sectional view taken along 3—3 in FIG. 1 in which the bit portion of the drive tool and the fastener recess as illustrated in FIG. 1 are engaged.

With reference to FIGS. 2 and 3, the keyway 42 extends through at least one bit flute 38 such that the stem portion 48 extends outwardly from between two neighboring bit lobes 40. An engaging surface 56 formed on the exposed end of the stem portion 48 between the two neighboring bit lobes 40 compressibly contacts a corresponding fastener lobe 58 formed inside the recess 24.

As shown in FIG. 3, when the drive tool 20 is engaged with the fastener 22, the recess 24, the outside surface 54 and inside surface 60 respectively, are cooperatively engaged. The convex bit lobes 40 cooperatively engage concave fastener flutes 62 to provide positive engagement so that rotational torque 36 applied to the drive tool 20 is most effectively transferred to the fastener 22. Some degree of dimensional difference between the drive tool 20 and the recess 24 in the fastener 22 is inherent due to manufacturing dimensional tolerances. Typically, the dimensional tolerances result in the fastener recess 24 being larger than the drive tool.

In order to minimize the effect of the dimensional difference between the bit portion 26 and the recess 24 the present invention forces the accumulation of the dimensional differences by compressing the engaging surface 56 of the interlobular fastener retention means 44 between the bit flute 38 through which it projects and the fastener lobe 58 which it engages. The engaging surface 56 of the stem portion 48 deforms to retain the fastener 22 in secure engagement with the bit portion 26. A cumulative dimensional difference produces a gap 64 between a portion of the inside surface 60 of the recess 24 and the outside 54 of the bit portion 26. The gap 64 generally does not create any detrimental effect on the engagement of the bit portion 26 in the recess 24 and the deformed engaging surface 56 securely retains the fastener 22 in engagement with the drive tool 20.

As shown in FIG. 4, the interlobular fastener retention means 44 is formed with generally the same cross-sectional shape as the keyway 42. As mentioned above, since an interference fit is created between the interlobular fastener retention means 44 and the keyway 42 the retention means 44 is retained in the keyway 42 during normal fastener driving applications. When necessary, such as upon wear or damage, the retention means 44 may be removed from the keyway 42 and replaced with a new retention means.

FIGS. 5 and 6 show an alternative embodiment employing retention means 44 having a similar cross-sectional shape as the retention means 44 as illustrated in FIG. 4. FIG. 7 provides another alternative embodiment whereby the bit portion does not have a bore formed through it for receiving the interlobular retention means 44.

The alternative embodiment illustrated in FIGS. 5 and 6 uses a keyway **42*a* having a keyway access 66 which is generally perpendicular to the bit axis 32. The alternative embodiment shown in FIG. 5 has a keyway 42*a* formed perpendicular to the bit axis 32 extending through one bit flute 38 of the bit portion 26. The alternative embodiment illustrated in FIG. 6 shows the keyway 42*b* extending through two opposed concave bit flutes 38**.

An alternative embodiment of the present invention is illustrated in FIG. 7. The alternative embodiment does not require removal of material from the bit portion 26 in order to provide interlobular fastener retention means 44. While the alternative embodiment as illustrated in FIG. 7 employs the same principals to achieve the same functions as the embodiment illustrated in FIGS. 1–6, the alternative embodiment is secured to the outside surface of the drive tool 20. Elements of alternate interlobular fastener retention means **44*a* illustrated in FIG. 7 which perform like functions as the interlobular fastener retention means 44** are designated by like reference numerals with the suffix "a".

The interlobular fastener retention means **44*a* is retained on the drive tool 20 generally around the shank portion 30. The retaining portion 46*a* is formed as a retaining ring 67 which securely circumferentially engages an outside surface 68 of the shank 30. The stem portion 48*a* is a curved elongated finger 69 attached to the retaining portion 46*a* and generally perpendicularly extends away from the retaining portion 46*a* and generally parallel to the bit axis 32 between two concave partially-cylindrical surfaces 38. Curved portions 70 are formed generally perpendicular to the bit axis 32 spaced along the stem portion 48*a* positioned in a concave partially-cylindrical surface 38. The curved portions 70 create biasing forces on a corresponding concave partially-cylindrical surface 38 formed in the recess 24 of the fastener 22 when the drive tool 20 is engaged therewith. Biasing forces created by the curve surfaces 70 of the stem portion 48*a* retain the fastener 22 on the drive tool 20** and minimize the degree of wobble.

The interlobular fastener retention means **44*a* illustrated in FIG. 7 are generally formed of a rigid material having appropriate flexibility characteristics to produce biasing forces when appropriately curved as in curved portion 70. The retaining portion 46*a* is formed with a dimension generally closely approximating the outside dimension of the outside surface 68 of the shank 30 on which it is attached. Additionally, the curved portions 70 generally include at least a convex curve 72 formed near a free end 74 and a concave curve 76 generally formed distal the free end 74. The concave curve 76 provides additional retaining forces by engaging a sloped merging surface 78 formed in the bit flute 38 thus limiting the distance which the stem portion 48*a* may travel parallel to the axis of curvature 41 of the concave partially-cylindrical surface 38 in which it is positioned. The free end 74 is generally formed pointing inwardly toward the bit axis 32 to prevent interference and facilitate ease of insertion when the bit portion 26 is inserted into a recess 24 of a fastener 22**.

In use, a drive tool 20 is formed with a bit portion 26 for cooperatively engaging a recess 24 formed in a fastener 22. The surfaces of the recess 24 and the bit portion 46 are formed with cooperatively engageable alternating merging concave and convex partially-cylindrical surfaces 38, 40. The free end 28 of the bit portion 26 is formed with a keyway 42 therein. At least a portion of the keyway extends through a concave partially-cylindrical surface 38 between two convex partially-cylindrical surfaces 40. Interlobular fastener retention means 44 is formed of a resiliently compressible material as an integral single piece body in a shape closely approximating the shape of the keyway 42 formed in the bit portion 26. The interlobular fastener retention means 44 is retained in the keyway 42 and an engaging surface 56 of the interlobular fastener retention means 44 projects a distance away from the bit portion 26 between two neighboring convex partially-cylindrical surfaces 40.

The interlobular fastener retention means **44*a* also may be formed as an integral single piece body which is retained on the outside of the drive tool 20 without necessitating the removal of material from the free end 28 of the bit portion 26. The retaining portion 46*a* is cooperatively formed around an outside surface 68 of the shank 30. The stem portion 48*a* projects away from the retaining portion 46*a* between two neighboring convex partially-cylindrical surfaces 40 and is formed with curved portions 70 that create biasing forces when compressed by a corresponding convex partially-cylindrical feature formed in a fastener recess 24**.

The interlobular fastener retention means 44 as illustrated in both embodiments securely removably retains a fastener on the bit portion 26 when the bit portion 26 is inserted into the fastener recess 24. When inserted as such, the interlobular fastener retention means 44, **44*a* is compressed between the two neighboring convex partially-cylindrical surfaces 40 between which it is retainably positioned. The biasing forces created by compression of the engaging surface 56 creates an interference fit between the bit portion 26 and the recess 24. The interference fit, as well as retaining the fastener 22 on the drive tool 20, eliminates wobble when the fastener 22 is driven by the drive tool 20. Wobble is eliminated since the interlobular fastener retention means 44 substantially eliminates the cumulative dimensional difference 64 between the outside surface 54 of the bit portion 26 and the inside surface 60 of the fastener recess 24. The retention means 44 forces the bit axis 32 and central axis 34 into parallel alignment thus preventing angular deviation between the two axes 32, 34 and wobble. Additionally, since the drive tool 20 is coaxially insertable, the bit axis 32 being coaxial with the central axis 34 of the fastener 22 and the axes of curvature 41 of the bit flutes and lobes 38, 40 being parallel, the retaining forces of the driven fastener 22 are not compromised when the bit portion 20 is extracted from the recess 24**.

While preferred embodiments of the present invention are shown and described, it is envisioned that those skilled in the art may devise various modifications of the present invention without departing from the spirit and scope of the appended claims.

The invention is claimed as follows:

1. A fastener drive tool for applying a rotational torque to a threaded fastener for driving said fastener, said drive tool comprising: an elongated shank portion; a free end of said shank portion engageable with a recess formed in said fastener; alternating concave and convex surfaces formed proximate said free end on an outside surface of said shank portion to define a multilobular surface for engagement in a correspondingly shaped recess in a fastener member, interlobular fastener retention means attached to said drive tool between two convex surfaces proximate said free end and engageable with a corresponding convex surface formed in said recess formed in said fastener for removably retaining said fastener on said drive tool shank portion when said drive tool is engaged with said recess formed in said fastener and preventing wobbling of said fastener when driven by said drive tool, said interlobular fastener retention means comprising an elastomeric body removably engaged with said drive tool.

2. A fastener drive tool according to claim 1, wherein said elastomeric body comprises a retaining portion and a stem portion, said retaining portion retaining said interlobular fastener retaining means in engagement with said drive tool, an engaging surface formed on said fastener retention means extending between said convex surfaces formed on said drive tool and being biasedly deformable between said convex surfaces.

3. A fastener drive tool according to claim 1, wherein said interlobular fastener retention means is an integral single piece body removably retained proximate said free end.

4. A fastener drive tool according to claim 1, wherein said alternating concave and convex surfaces are formed as partially-cylindrical surfaces, axes of curvature of said concave and convex partially-cylindrical surfaces generally parallel one another.

5. A fastener drive tool for driving fasteners, drive tool receiving means formed on said fasteners for removably engaging said drive tool, said drive tool comprising: a shank portion; a free end of said shank portion removably engageable with said tool receiving means; alternating concave and convex surfaces formed on an outside surface of said shank portion defining a multilobular surface portion for engagement in a correspondingly shaped recess in a fastener member; a keyway formed in said shank portion, at least a portion of said keyway extending through said outside surface of said shank portion interposed between two of said convex surfaces; interlobular fastener retention means replaceably retained in said keyway for removably engaging said fastener, said interlobular fastener retention means comprising an elastomeric body removably engageable with said keyway formed in said shank.

6. A fastener drive tool according to claim 5, in which a keyway axis extends through said keyway parallel to said axes of curvature of said concave and convex partially-cylindrical surfaces.

7. A fastener drive tool according to claim 5, wherein said interlobular fastener retention means is an integral single piece body formed for cooperatively insertably engaging said keyway and having an interference fit when engaged therewith.

8. A faster drive tool according to claim 7, wherein said interlobular fastener retention means is formed of an elastomeric resiliently compressible material.

9. A fastener drive tool for driving fasteners, drive tool receiving means formed on said fasteners for removably engaging said drive tool, said drive tool comprising: a shank portion; a free end of said shank portion removably engageable with said tool receiving means; alternating concave and convex surfaces formed on an outside surface of said shank portion to define a multilobular surface portion for engagement in a correspondingly shaped recess in a fastener member; a keyway formed in said shank portion, at least a portion of said keyway extending through said outside surface of said shank portion between two of said convex surfaces; interlobular fastener retention means replaceably retained in said keyway for removably engaging said fastener, said keyway and said corresponding interlobular fastener retention means are formed with a retaining portion and a stem portion attached thereto, said retaining portion having a cross-sectional width dimension generally greater than a cross-section width dimension of said stem portion for retaining said interlobular fastener retention means in engagement with said keyway.

10. A fastener drive tool for driving fasteners, drive tool receiving means formed on said fasteners for removably engaging said drive tool, said drive tool comprising: a shank portion; a free end of said shank portion removably engageable with said tool receiving means; alternating concave and convex surfaces formed on an outside surface of said shank portion to define a multilobular surface portion for engagement in a correspondingly shaped recess in a fastener member; a keyway formed in said shank portion, at least a portion of said keyway extending through said outside surface of said outside surface of said shank portion between two of said convex surfaces; interlobular fastener retention means replaceably retained in said keyway for removably engaging said fastener, said interlobular fastener retention means includes a biasing stem portion attached to and retained on said shank by a retaining clip, said biasing stem portion being positioned between two of said convex surfaces, said retaining clip retainably attached to said shank for retaining said biasing stem portion attached thereto in position between said two convex surfaces.

11. A fastener drive tool according to claim 10, wherein a distal end of said biasing stem portion is formed projecting toward said concave surface formed between said two convex surfaces between which said biasing stem portion is positioned for preventing interference between said biasing stem portion and said fastener when said biasing stem portion is engaged with said fastener.

12. A drive tool for use with a fastener to selectively releasably retain said fastener on said drive tool and to prevent wobble of said fastener retained thereon when a driving force is applied by said drive tool to said fastener, said drive tool comprising: a shank portion; alternating concave and convex surfaces formed on an outside surface of said shank to define a multilobular surface portion for engagement in a correspondingly shaped recess in a fastener member; interlobular fastener retention means attached to said shank portion for creating a releasable resiliently compressible interference fit between said drive tool and said fastener when said drive tool is engaged with said fastener, said interlobular fastener retention means being attached to an outside surface of said drive tool and positioned in a concave partially-cylindrical surface between two of said convex partially-cylindrical surfaces and being compressed by a corresponding convex partially-cylindrical surface formed in said recess in said fastener when said drive tool is engaged in said fastener, said interlobular fastener retention means comprise a removably attachable retention member and a stem member attached thereto, said stem member formed for creating an interference fit with said shank for retaining said interlobular fastener retention means thereon and said retention member attached to said stem member for extending from between two convex surfaces.

13. A drive tool according to claim 12, wherein said interlobular fastener retention means is removably attachable to said shank portion for replacing said interlobular fastener retention means upon wear or damage thereto.

14. A fastener drive tool according to claim 12, wherein said alternating concave and convex surfaces are formed as partially-cylindrical surfaces, axes of curvature of said concave and convex partially-cylindrical surfaces generally parallel one another.

15. A fastener drive tool according to claim 12, wherein said interlobular fastener retention means is retained on an outside surface of said shank portion, said stem member being formed of a rigid material corresponding to the contours formed on the outside of said shank portion and circumscribing said shank portion for creating an interference fit with said shank portion for retaining said interlobular fastener retention means thereon and said retention member being biasedly formed with at least two opposed curves formed therein and being generally elongated and attached to and extending from said stem member being interposed between two convex surfaces.

* * * * *